US008992263B2

(12) United States Patent
Fallon et al.

(10) Patent No.: US 8,992,263 B2
(45) Date of Patent: Mar. 31, 2015

(54) SERIAL BUS RECEPTACLE WITH EXTERIOR SOCKET CLAMPING

(75) Inventors: Matthew R. Fallon, Austin, TX (US); Dennis Vance Toth, Austin, TX (US); Christopher A. Rake, Austin, TX (US)

(73) Assignee: National Instruments Corporation, Austin, TX (US)

( * ) Notice: Subject to any disclaimer, the term of this patent is extended or adjusted under 35 U.S.C. 154(b) by 168 days.

(21) Appl. No.: 13/564,040

(22) Filed: Aug. 1, 2012

(65) Prior Publication Data

US 2014/0038449 A1 Feb. 6, 2014

(51) Int. Cl.
*H01R 24/00* (2011.01)
*H01R 12/50* (2011.01)
*H01R 13/26* (2006.01)

(52) U.S. Cl.
CPC ..... *H01R 23/7073* (2013.01); *H01R 13/26* (2013.01)
USPC ..... 439/660

(58) Field of Classification Search
CPC .. H01R 13/6395; H01R 13/658; H01R 23/02; H01R 13/18; H01R 23/7073; H01R 23/725; H01R 13/26
USPC ..... 439/660, 370, 607.41, 607.47, 839
See application file for complete search history.

(56) References Cited

U.S. PATENT DOCUMENTS 3,671,921 A * 6/1972 Baker et al. ..... 439/353
4,639,067 A * 1/1987 Kikuta ..... 439/607.41
4,875,866 A * 10/1989 Winant ..... 439/140
4,884,981 A * 12/1989 Chandler et al. ..... 439/607.41
5,573,434 A * 11/1996 Ittah et al. ..... 439/839
5,658,170 A * 8/1997 Tan et al. ..... 439/607.41
5,685,739 A * 11/1997 Davis et al. ..... 439/607.38
5,709,569 A * 1/1998 Buck et al. ..... 439/607.01
5,975,954 A * 11/1999 Wu et al. ..... 439/607.35
6,004,160 A * 12/1999 Korsunsky et al. ..... 439/660
6,059,581 A * 5/2000 Wu ..... 439/79
6,093,045 A * 7/2000 Hoff ..... 439/357
6,162,089 A * 12/2000 Costello et al. ..... 439/541.5
6,554,648 B2 * 4/2003 Shi et al. ..... 439/607.55
6,926,557 B1 * 8/2005 Yamaguchi et al. ..... 439/607.54
7,011,533 B2 * 3/2006 Miyamoto ..... 439/95
7,104,832 B2 9/2006 Campbell et al.
7,219,423 B2 5/2007 Johnson et al.
7,364,109 B2 * 4/2008 Kuo ..... 242/373
7,416,419 B2 * 8/2008 Collantes, Jr. et al. ..... 439/76.1
7,476,129 B2 * 1/2009 Droesbeke et al. ..... 439/607.41
7,502,949 B2 * 3/2009 Park ..... 713/300

(Continued)

*Primary Examiner* — Abdullah Riyami
*Assistant Examiner* — Vladimir Imas
(74) *Attorney, Agent, or Firm* — Meyertons Hood Kivlin Kowert & Goetzel, P.C.; Jeffrey C. Hood

(57) ABSTRACT

System and method for communicatively coupling a serial communication plug to a serial communication bus. The system may include a housing. The housing may include a receptacle that is configured to communicatively couple to a bus. The receptacle may include one or more internal retention springs situated inside the receptacle. The one or more internal retention springs may be configured to grip a male plug with a retention force, when the male plug is inserted into the receptacle. The housing may include or may be coupled to a clamp where the clamp is external to the receptacle. When the male plug is inserted into the receptacle, the clamp may be adjustable via a clamp adjustment mechanism to constrain the one or more internal retention springs, thus augmenting the retention force and further securing the male plug in the receptacle.

22 Claims, 9 Drawing Sheets

(56) References Cited

U.S. PATENT DOCUMENTS

| | | | | |
|---|---|---|---|---|
| 7,677,926 | B1 * | 3/2010 | Huang | 439/607.38 |
| 7,744,400 | B2 * | 6/2010 | Carmitchel | 439/369 |
| 7,784,727 | B1 * | 8/2010 | Liao | 242/378.1 |
| 7,874,864 | B2 * | 1/2011 | Luu | 439/373 |
| 7,878,865 | B2 * | 2/2011 | Desrosiers et al. | 439/680 |
| 7,946,893 | B2 * | 5/2011 | Chen et al. | 439/660 |
| 7,990,102 | B2 * | 8/2011 | Scheucher | 320/107 |
| 8,011,947 | B2 * | 9/2011 | Lai et al. | 439/358 |
| 8,075,331 | B2 * | 12/2011 | Gazelot et al. | 439/353 |
| 8,113,887 | B2 * | 2/2012 | Osawa et al. | 439/637 |
| 8,171,762 | B2 | 5/2012 | Hsiao et al. | |
| 8,298,009 | B2 * | 10/2012 | Elkhatib et al. | 439/581 |
| 8,323,057 | B2 * | 12/2012 | Ho | 439/660 |
| 8,337,236 | B2 * | 12/2012 | Shu | 439/369 |
| 8,342,857 | B2 * | 1/2013 | Palli et al. | 439/38 |
| 8,390,466 | B2 * | 3/2013 | Feldstein et al. | 340/654 |
| 8,390,467 | B2 * | 3/2013 | Feldstein et al. | 340/654 |
| 8,460,036 | B1 * | 6/2013 | Chen | 439/660 |
| 8,641,455 | B2 * | 2/2014 | Lan | 439/660 |
| 8,651,898 | B2 * | 2/2014 | Duan et al. | 439/660 |
| 2009/0088023 | A1 * | 4/2009 | Bridges et al. | 439/607 |

* cited by examiner

SERIAL BUS RECEPTACLE WITH EXTERIOR SOCKET CLAMPING

FIELD OF THE INVENTION

The present invention relates to the field of serial communication bus connector design. Specifically, the present invention addresses the problem of serial communication bus plug retention by augmenting the retention force of serial communication bus receptacles.

DESCRIPTION OF THE RELATED ART

Certain types of serial communication cables, such as universal serial bus (USB) cables have a multitude of mainstream applications and allow for a wide variety of connectivity options. However, in certain environments, the low force necessary to decouple the connection of the cable has limited the use of these types of connections. For example, the USB specification provides bounds for the insertion and withdrawal forces needed to respectively couple and decouple the connection. This force limit is designed to maintain connection through very minor disturbances, but to separate easily when a user desires. Applications in the industrial market, however, require greater retention than typically provided by current serial bus interfaces and thus these applications need alternatives to or modifications for typical connectors to increase the retention force. Various solutions have been employed to accomplish an increase in retention force, especially with respect to USB connectors, but these solutions are not ideal for all industrial applications.

For example, U.S. Pat. No. 7,878,865 discloses a locking connector for engaging a USB receptacle. The connector housing has a locking cam opening on one side of the connector and the connector is split on the same side as the locking cam and allows for a cam to be incorporated into the connector. Additionally, there is a locking sleeve that actuates the cam and closes the split in the connector locking the connector in the receptacle. While an improvement over the standard connector, this system does not allow standard peripherals to be connected to a system in an industrial environment since most peripherals are equipped with a plug and not a receptacle. This solution requires a change by the peripheral manufacturer or an after market modification.

U.S. Patent Application 2009/0088023 discloses a locking receptacle for engaging a USB device. The locking receptacle includes a four sided header that is connected to a pivotable lever that is connected to a locking tip where the locking tip engages the USB connector plug when the plug is inserted and the lever is pivoted. In this solution, the receptacle does not include retention springs. The locking tip of the pivotable lever restricts the movement of the plug. While more robust than the standard USB receptacle, this solution is not ideal for harsh industrial environments because the locking tip and lever are typically flexible and tend to lose retention force over time, therefore the connector becomes unreliable over time.

Various other solutions are available such as locking USB connectors that provide retention via a rigid plastic collar that envelopes the main body of the receptacle. The collar can slide along the main body and prevents the retention tabs of the connector from deflecting and thus prevents the USB plug from being withdrawn. However, this solution relies on a plastic collar that may not be rugged enough for industrial environments or allow for the use of standard peripherals. For example, the sliding collar may be more susceptible to loosening under the vibrations that are common in industrial environments. Additionally, the sliding collar may not be practical for use in some industrial environments given the method of actuation of the sliding collar.

Finally, there are solutions in which mating plastic barrels are fitted over the plug and receptacle and are threaded together to provide retention of the plug; however, these solutions require dedicated ends and do not allow for the exchange and use of standard peripherals.

SUMMARY OF THE INVENTION

Various embodiments of a system for connecting serial communication devices are presented. The system may include a housing that may be configured to couple to a serial communication bus. In one embodiment of the present invention, the serial communication bus may be USB. The housing may include a serial bus receptacle, which, in various embodiments, may by a USB receptacle. The serial bus receptacle may be communicatively coupled to the serial communication bus. The receptacle may include one or more internal retention springs that are internal to the serial bus receptacle. The one or more internal retention springs are configured to grip a male serial bus plug, which, in various embodiments, may be a USB plug, with a retention force when the male serial bus plug is inserted into the serial bus receptacle. In one embodiment, the serial bus plug may be communicatively coupled to a serial communication device so when the serial bus plug is inserted into the serial bus receptacle, the serial communication device is coupled to the serial communication bus. In some embodiments, the serial communication device may be a USB device.

The housing may contain or be coupled to a clamp, where the clamp is external to the serial bus receptacle. Further, when the clamp is adjusted via a clamping adjustment mechanism, the clamp may constrain the one or more internal retention springs and augment the retention force of the one or more internal retention springs. By augmenting the retention force of the one or more internal retention springs, the clamp further secures the male serial bus plug in the serial bus receptacle.

In one embodiment, the housing may be included on or connected to a serial communication cable and may be coupled to the serial communication bus via the serial communication cable, which, in another embodiment, may be a USB cable. The housing which may contain the serial bus receptacle may be included on one end of the serial communication cable and the serial bus receptacle may be communicatively coupled to the serial communication bus via the serial communication cable. In alternative embodiments, the serial communication cable may contain a housing as described above on one end and a serial bus plug, which in one embodiment, may be a USB plug, on the other end of the serial communication cable. In yet another embodiment, the serial communication cable may include a housing as described above on both ends, both of which may contain a serial communication receptacle, both of which, in another embodiment, may be USB receptacles.

In one embodiment, the clamping adjustment mechanism may include one or more threaded fasteners and a corresponding one or more threaded inserts. The threaded inserts may be included in or coupled to the housing. The clamp is configured to close in response to the one or more threaded fasteners being threaded into the corresponding one or more threaded inserts.

In an alternative embodiment, the clamping adjustment mechanism may include one or more threaded fasteners and a corresponding one or more threaded nuts. The clamp is configured to close in response to the one or more threaded fasteners being threaded into the corresponding one or more threaded nuts.

In another embodiment, the clamp may have a deploy position and a service position. When the clamp is in the deploy position, the clamp is closed thus further securing the male serial bus plug that has been inserted into the serial bus receptacle. When the clamp is in the service position, the clamp is opened thus allowing the removal of the male serial bus plug from the serial bus receptacle.

In another embodiment, the housing may be included in or coupled to a panel. The serial communication receptacle may be accessible from the front side of the panel or protrude through the front side of the panel. Additionally, the clamping adjustment mechanism may be accessible from the front side of the panel or protrude through the front side of the panel. In various embodiments, the panel may include a bulkhead, an enclosure, a computer panel, an instrument chassis such as a National Instruments's PXI™ or cRIO™ chassis, or other various panels.

In one embodiment, a male serial bus plug may be inserted into a serial bus receptacle. In various embodiments, the serial bus plug may be coupled to a serial communication device. The serial bus receptacle may be communicatively coupled to a serial communication bus. Thus, when the serial bus plug is inserted into the serial bus receptacle, the serial communication device is communicatively coupled to the serial communication bus. As described above, in some embodiments, the serial bus receptacle may include one or more internal retention springs situated inside the serial bus receptacle. These springs may be configured to grip the male serial bus plug with a retention force in response to the inserting. The serial bus receptacle may be included in a housing, which includes or is coupled to a clamp, and where the clamp is external to the serial bus receptacle. The clamp may be adjusted via a clamping adjustment mechanism to constrain the one or more internal retention springs. The constraining of the one or more internal retention springs augments the retention force of the one or more internal retention springs and further secures the male serial bus plug in the serial bus receptacle.

Various embodiments may be used to communicatively couple various serial communication devices to the serial communications bus. In one embodiment, the serial communication bus may be USB, the serial bus receptacle may be a USB receptacle, the male serial bus plug may be a USB plug, and the serial communication device may be a USB device. In other embodiments, the housing may be included in or connected to a serial communication cable and the serial bus receptacle may be communicatively coupled to the serial communication bus via the serial communication cable. Additionally, in one embodiment, the serial communication cable may by a USB cable.

BRIEF DESCRIPTION OF THE DRAWINGS

A better understanding of the present invention can be obtained when the following detailed description of the preferred embodiment is considered in conjunction with the following drawings, in which.

Figure 1:
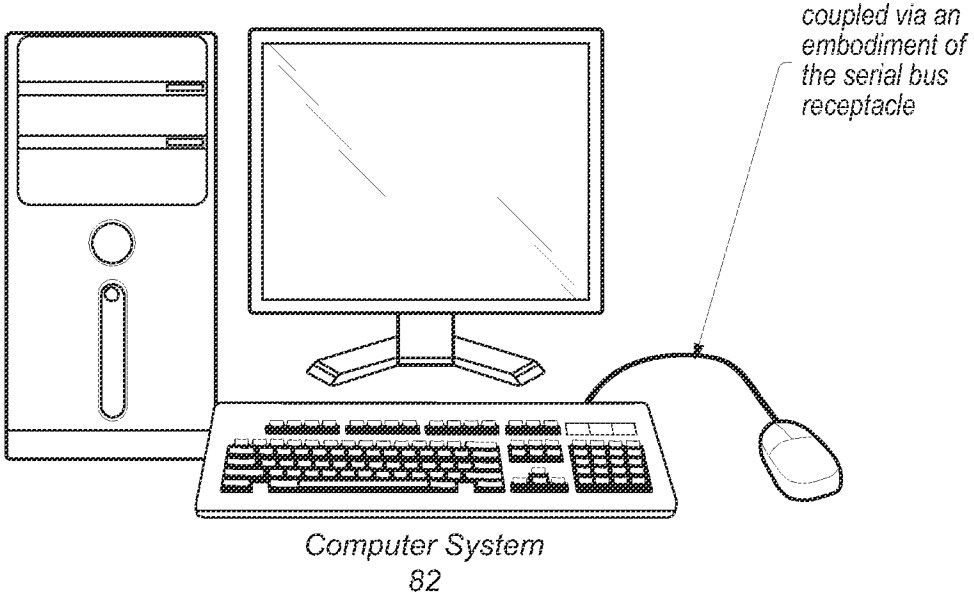
FIG. 1 illustrates computer system, according to one embodiment.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Terms

The following is a glossary of terms used in the present document.

Computer System—any of various types of computing or processing systems, including a personal computer system (PC), mainframe computer system, workstation, network appliance, Internet appliance, personal digital assistant (PDA), television system, grid computing system, or other device or combinations of devices. In general, the term "computer system" can be broadly defined to encompass any device (or combination of devices) having at least one processor that executes instructions from a memory medium.

Measurement Device—includes instruments, data acquisition devices, smart sensors, and any of various types of devices that are configured to acquire and/or store data. A measurement device may also optionally be further configured to analyze or process the acquired or stored data. Examples of a measurement device include an instrument, such as a traditional stand-alone "box" instrument, a computer-based instrument (instrument on a card) or external instrument, a data acquisition card, a device external to a computer that operates similarly to a data acquisition card, a smart sensor, one or more DAQ or measurement cards or modules in a chassis, an image acquisition device, such as an image acquisition (or machine vision) card (also called a video capture board) or smart camera, a motion control device, a robot having machine vision, and other similar types of devices. Exemplary "stand-alone" instruments include oscilloscopes, multimeters, signal analyzers, arbitrary waveform generators, spectroscopes, and similar measurement, test, or automation instruments.

A measurement device may be further configured to perform control functions, e.g., in response to analysis of the acquired or stored data. For example, the measurement device may send a control signal to an external system, such as a motion control system or to a sensor, in response to particular data. A measurement device may also be configured to perform automation functions, i.e., may receive and analyze data, and issue automation control signals in response.

FIG. 1—Computer System

As shown in FIG. 1, the computer system 82 may include a display device configured to display a graphical program as the graphical program is created and/or executed. The display device may also be configured to display a graphical user interface or front panel of the graphical program during execution of the graphical program. The graphical user interface may comprise any type of graphical user interface, e.g., depending on the computing platform.

The computer system 82 may include at least one input device, such as a keyboard or mouse that may be coupled to the computer system 82 using various embodiments of the present invention.

Exemplary Systems

It is noted that embodiments of the present invention can be used for a plethora of applications and is not limited. In other words, applications discussed in the present description are exemplary only, and embodiments of the present invention may be used in any of various types of systems. Thus, embodiments of the system and method disclosed herein may be used in any of various types of applications.

Figure 2A:
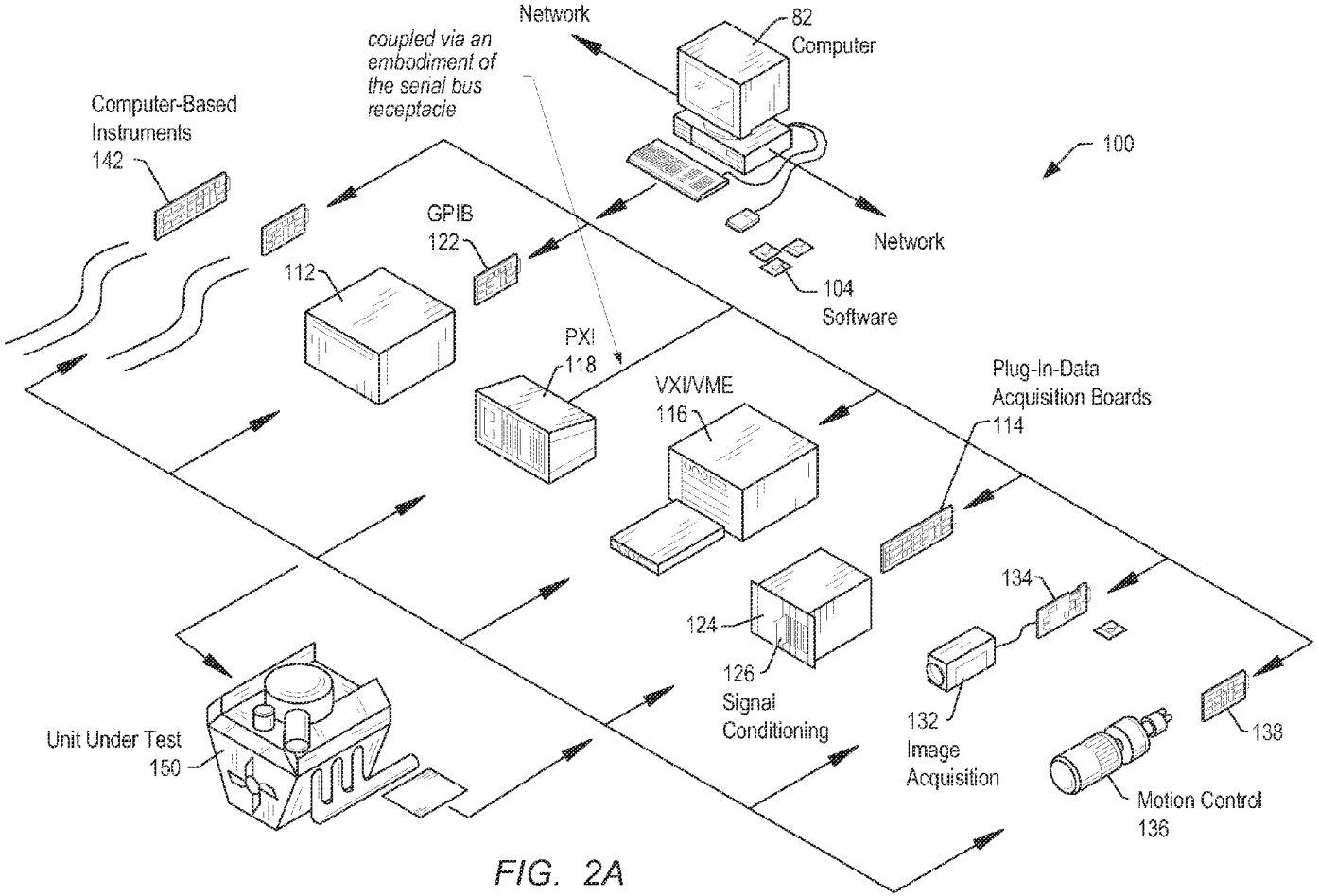
FIG. 2A illustrates an instrumentation control system, according to one embodiment.

FIG. 2A illustrates an exemplary instrumentation control system 100 which may implement various embodiments of the invention. The system 100 comprises a host computer 82 which may couple to one or more instruments via embodiments of the present invention. The host computer 82 may comprise a CPU, a display screen, memory, and one or more input devices such as a mouse or keyboard as shown. The computer 82 may operate with the one or more instruments to analyze, measure, or control a unit under test (UUT) or process 150.

The one or more instruments may include a GPIB instrument 112 and associated GPIB interface card 122, a data acquisition board 114 inserted into or otherwise coupled with chassis 124 with associated signal conditioning circuitry 126, a VXI instrument 116, a PXI instrument 118, a video device or camera 132 and associated image acquisition (or machine vision) card 134, a motion control device 136 and associated motion control interface card 138, and/or one or more computer based instrument cards 142, among other types of devices. The computer system may couple to and operate with one or more of these instruments via embodiments of the present invention. The instruments may be coupled to the unit under test (UUT) or process 150, or may be coupled to receive field signals, typically generated by transducers via various embodiments of the present invention. The system 100 may be used in a data acquisition and control application, in a test and measurement application, an image processing or machine vision application, a process control application, a man-machine interface application, a simulation application, or a hardware-in-the-loop validation application, among others.

Figure 2B:
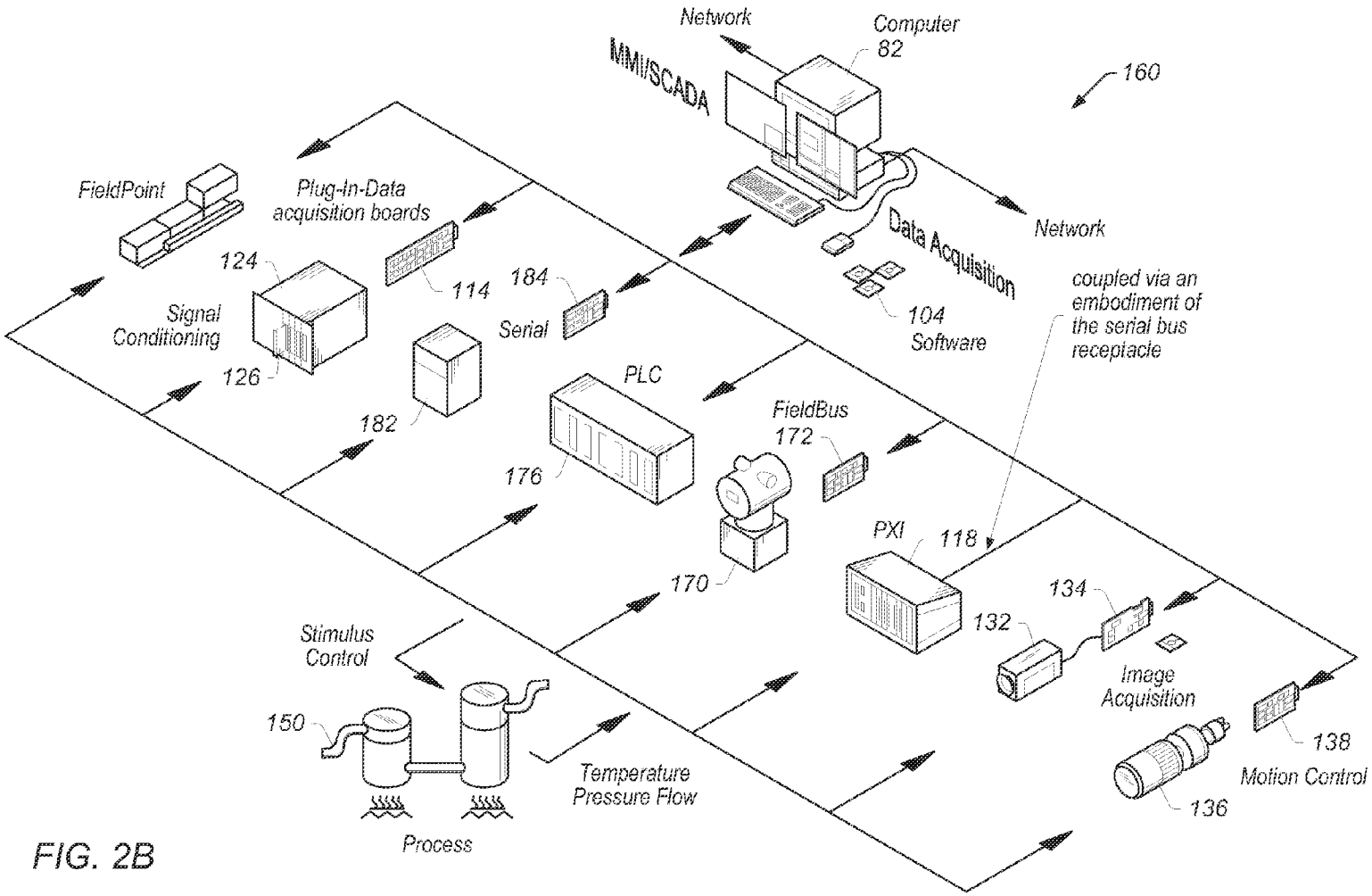
FIG. 2B illustrates an industrial automation system, according to one embodiment.

FIG. 2B illustrates an exemplary industrial automation system 160 which may use embodiments of the present invention. The industrial automation system 160 is similar to the instrumentation or test and measurement system 100 shown in FIG. 2A. Elements which are similar or identical to elements in FIG. 2A have the same reference numerals for convenience. The system 160 may comprise a computer 82 which may couple to one or more devices or instruments via various embodiments of the present invention. The computer 82 may comprise a CPU, a display screen, memory, and one or more input devices such as a mouse or keyboard as shown. The computer 82 may operate with the one or more devices to perform an automation function with respect to a process or device 150, such as MMI (Man Machine Interface), SCADA (Supervisory Control and Data Acquisition), portable or distributed data acquisition, process control, advanced analysis, or other control, among others.

The one or more devices may include a data acquisition board 114 inserted into or otherwise coupled with chassis 124 with associated signal conditioning circuitry 126, a PXI instrument 118, a video device 132 and associated image acquisition card 134, a motion control device 136 and associated motion control interface card 138, a fieldbus device 170 and associated fieldbus interface card 172, a PLC (Programmable Logic Controller) 176, a serial instrument 182 and associated serial interface card 184, or a distributed data acquisition system, such as the Fieldpoint system available from National Instruments, among other types of devices. Each of the one or more devices may couple to the system via various embodiments of the present invention.

Exemplary Embodiments

Figure 3:
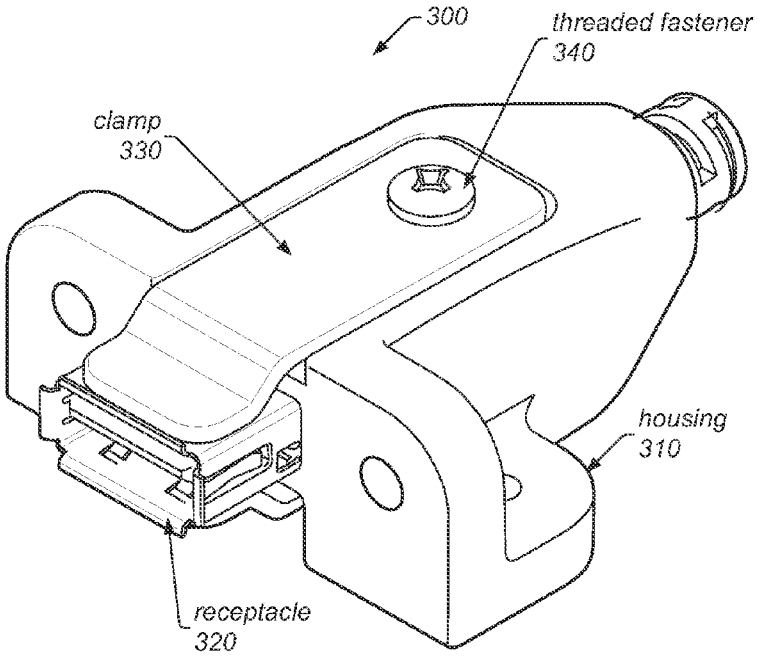
FIG. 3 is an isometric view of the invention, according to one embodiment.
Figure 4:
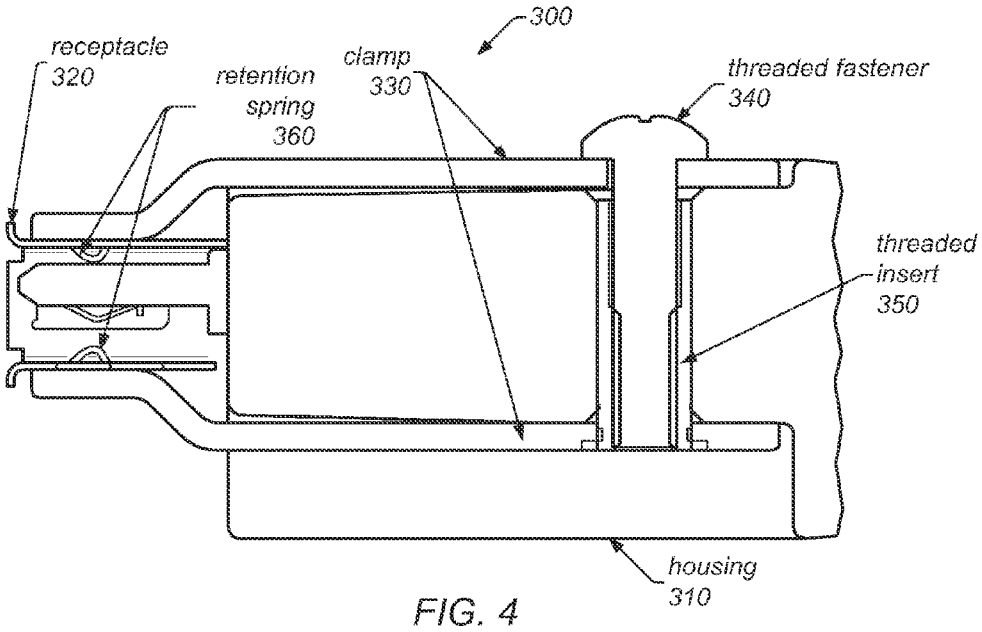
FIG. 4 is a cross section view of the invention, according to one embodiment.
Figure 5:
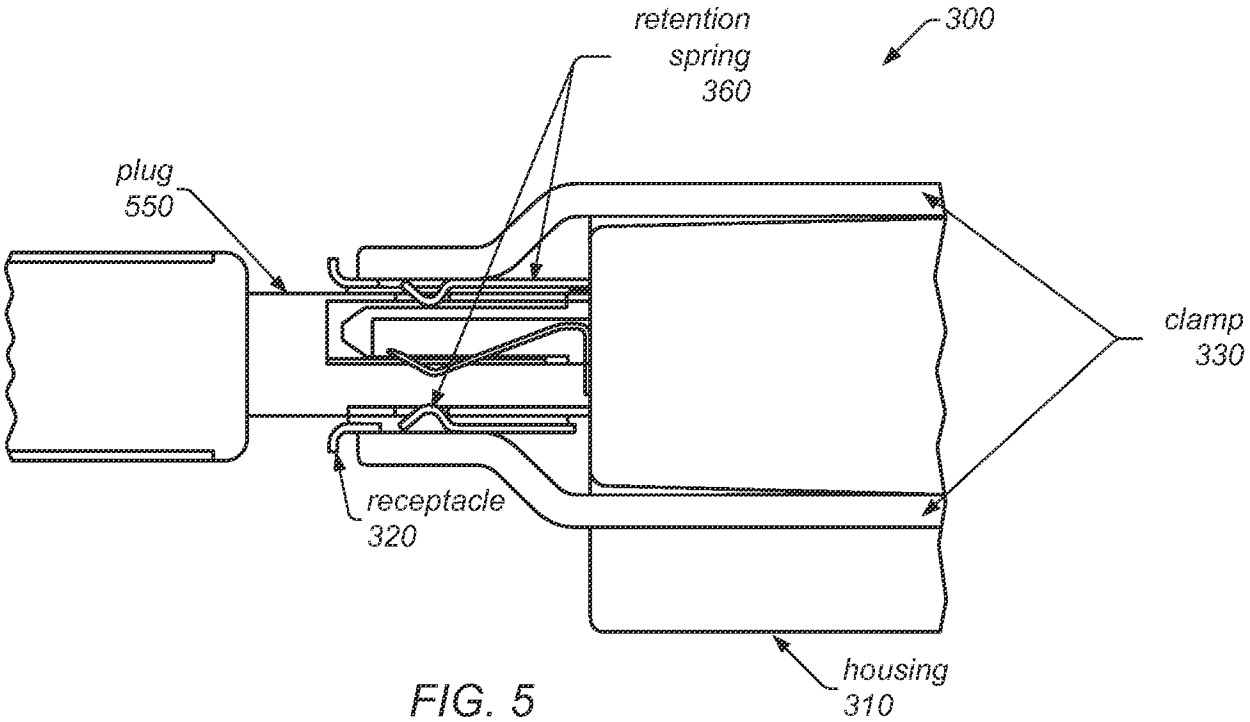
FIG. 5 is a cross section view of the invention with serial plug engaged, according to one embodiment.

One embodiment, connector 300, of the present invention is illustrated in FIGS. 3-5. The housing 310 may be configured to couple to a serial communication bus. The housing 310 may include a serial bus receptacle 320. The serial bus receptacle 320 may be configured to communicatively couple to the serial communication bus. The serial bus receptacle 320 may include one or more internal retention springs 360 situated inside the serial bus receptacle 320. The internal retention springs 360 may be configured to grip a male serial bus plug 550 with a retention force when the male serial bus plug is inserted into the serial bus receptacle 320.

A clamp 330 that may be either included in or coupled to the housing 310. The clamp 330 may be adjustable via a clamping adjustment mechanism to constrain the one or more internal retention springs 360 when a male serial bus plug 550 is inserted into the serial bus receptacle 320. The clamp 330 may then augment the retention force of the one or more internal retention springs 360, thus further securing the male serial bus plug 550 in the serial bus receptacle 360. In various embodiments, the serial communication bus may be a USB bus, the serial bus receptacle 320 may be a USB receptacle, and the male serial bus plug 550 may be a USB plug.

In one particular embodiment of the connector 300, as illustrated in FIGS. 3-5, the clamping adjustment mechanism may include one or more threaded fasteners 340 and a corresponding one or more threaded inserts 350. The threaded inserts 350 may be included in or coupled to the housing 310. The clamp may be configured to close in response to the one or more threaded fasteners 340 being threaded into the corresponding one or more threaded inserts 350. When the one or more threaded fasteners 340 are threaded into the corresponding one or more threaded inserts 350, the clamp 330 constrains the one or more internal retention springs 360 thus augmenting the retention force of the one or more internal retention springs 360 when a male serial plug 550 is inserted into the serial bus receptacle 320, as illustrated in FIG. 5.

Figure 6:
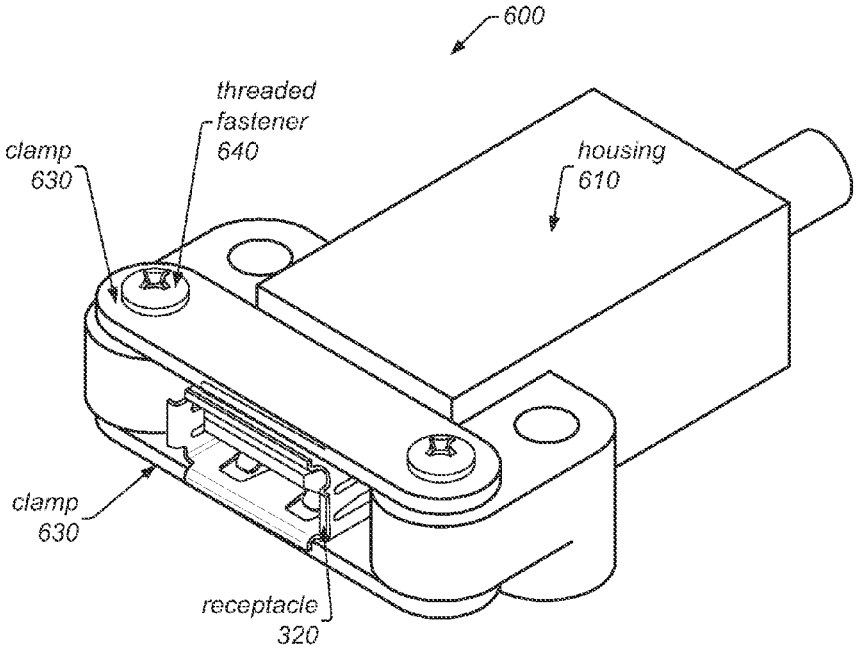
FIG. 6 is an isometric view of the invention, according to another embodiment.
Figure 7:
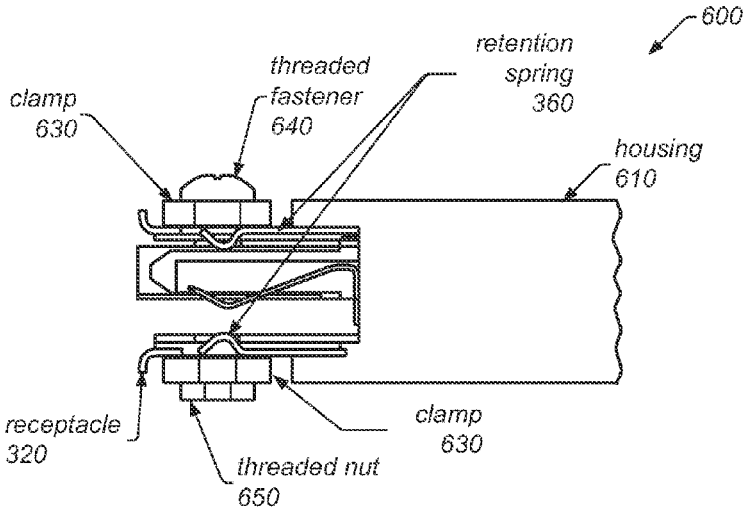
FIG. 7 is a cross section view of the invention, according to another embodiment.

In an alternative embodiment of the connector 600, as illustrated in FIGS. 6-7, the clamping adjustment mechanism may include one or more threaded fasteners 640 and a corresponding one or more threaded nuts 650. The clamp may be configured to close in response to the one or more threaded fasteners 640 being threaded into the corresponding one or more threaded nuts 650. When the one or more threaded fasteners 640 are threaded into the corresponding one or more threaded nuts 650, the clamp 630 constrains the one or more internal retention springs 360 thus augmenting the retention force of the one or more internal retention springs 360 when a male serial plug is inserted into the serial bus receptacle 320. It should be noted that the various clamping adjustment mechanisms described herein are meant to be exemplary only, and are not intended to limit the connector to any particular clamping adjustment mechanisms.

In one embodiment, the clamp may have a deploy position in which the clamp is closed. When in the deployed position, the clamp further secures the male serial bus plug that was inserted into a serial bus receptacle. Additionally, the clamp may have a service position in which the clamp is opened. When in the service position, the serial bus plug can be removed from the serial bus receptacle.

Figure 8:
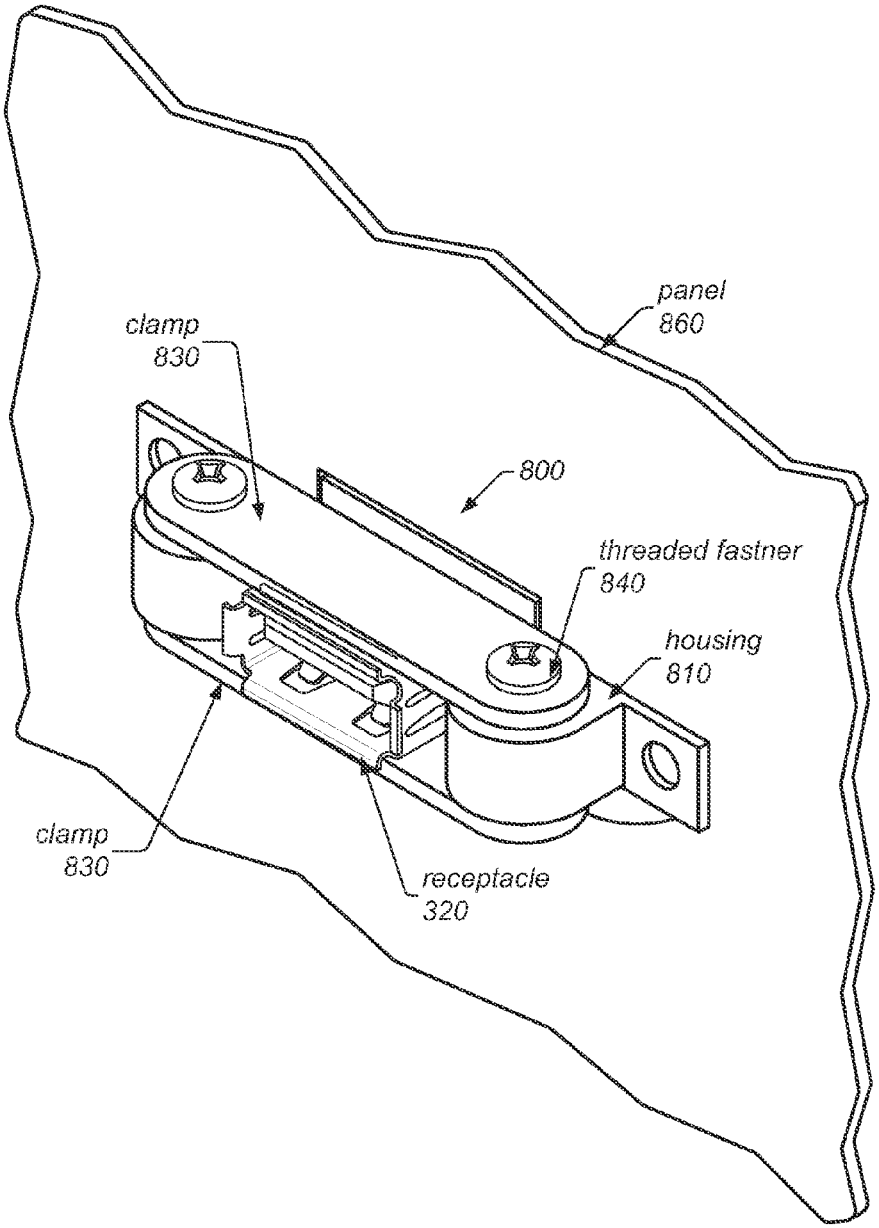
FIG. 8 is an isometric view of the invention, according to another embodiment.

FIG. 8 illustrates another embodiment of the present invention 800. The housing 810 may be included in or coupled to a panel 860. The serial bus receptacle 320 may protrude through the front side of the panel 860. In another embodiment, the serial bus receptacle 320 may be accessible from the front side of the panel 860. Furthermore, in one embodiment, as illustrated in FIG. 8 by clamp 830 and threaded fastener 840, the clamping adjustment mechanism may protrude through the front side of the panel 860. In another embodiment, the clamping adjustment mechanism may be accessible from the front side of the panel 860. In various embodiments, the panel 860 may include a bulkhead, an enclosure, a computer panel, an instrument chassis such as a National Instruments's PXI™ or cRIO™ chassis, or other various panels.

Figure 9A:
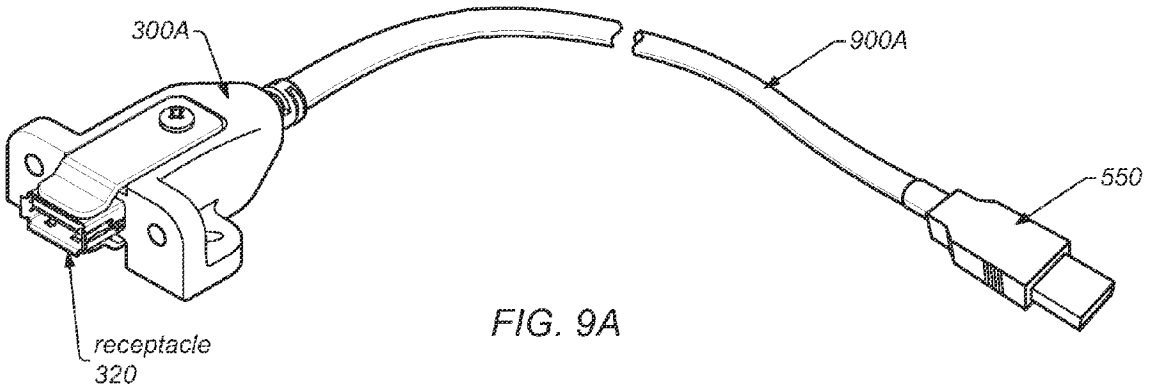
FIG. 9A is an isometric view of the invention, according to another embodiment.
Figure 9B:
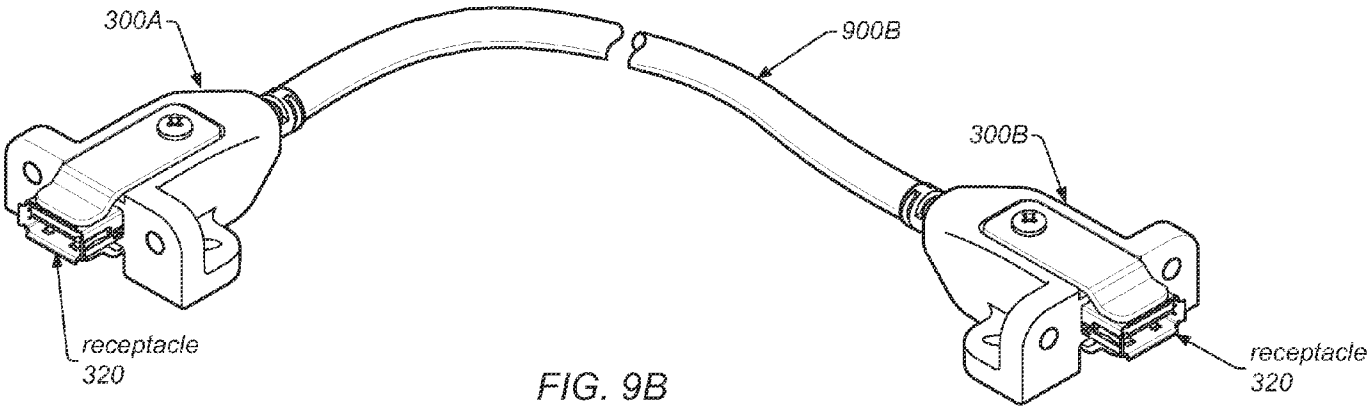
FIG. 9B is an isometric view of the invention, according to another embodiment.

FIGS. 9A and 9B illustrate exemplary embodiments where the connector 300, as described above in FIGS. 3-5, may be included on or connected to a serial communication cable 900 and may be communicatively coupled to the serial communication bus via the serial communication cable 900. In one embodiment, the serial communication cable 900A may include the connector 300A on one end and a male serial bus plug 550 on the other end, as illustrated in FIG. 9A. Alternatively, in another embodiment, referred to as cable 900B, the other end of the cable 900B may include another connector 300B, as illustrated in FIG. 9B. Thus, a cable so configured may be used to connect any of various serial communication devices to the serial communication bus. More specifically, in one embodiment, where the male serial bus plug is communicatively coupled to a serial communication device, when the male serial bus plug is inserted into the serial bus receptacle, the serial communication device is coupled to the serial communication bus via the serial communication cable 900. Additionally, in one embodiment, the serial communication cable 900 may be a USB cable, the serial bus receptacle 320 may be a USB receptacle, and the serial bus plug 550 may be a USB plug.

Figure 10:
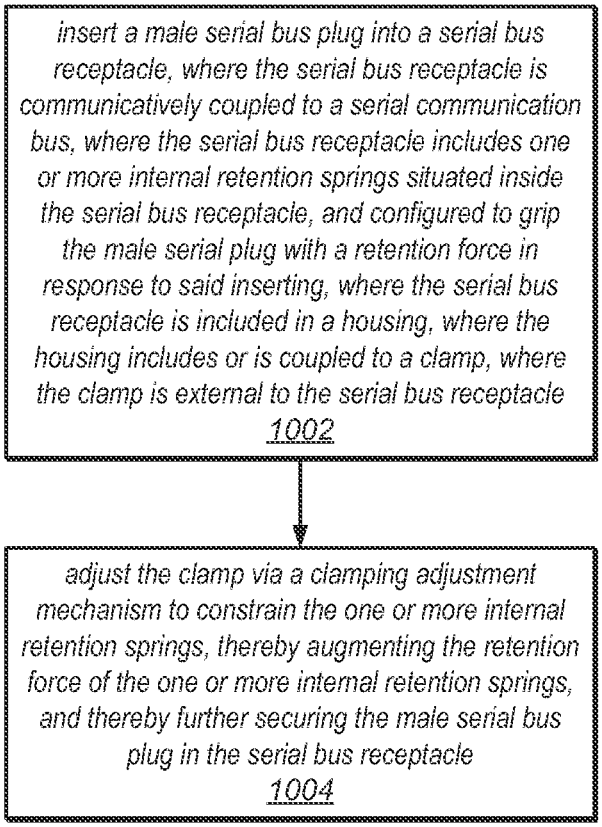
FIG. 10 is a flowchart describing an exemplary method of use of the invention, according to an embodiment.

FIG. 10—Method of Use of a Serial Bus Receptacle

FIG. 10 illustrates a method for inserting and retaining a male serial bus plug in a serial bus receptacle, according to one embodiment. The method shown in FIG. 10 may be used in conjunction with any of the computer systems, devices, or embodiments of the present invention described above, and shown in the above Figures, among other devices and embodiments. In various embodiments, some of the method elements shown may be performed concurrently, in a different order than shown, or may be omitted. Additional method elements may also be performed as desired. As shown, this method may operate as follows.

In 1002, a male serial bus plug may be inserted into a serial bus receptacle. The serial bus receptacle may be communicatively coupled to a serial communication bus. As described above, in some embodiments, the serial bus receptacle may include one or more internal retention springs situated inside the serial bus receptacle. These springs may be configured to grip the male serial bus plug with a retention force in response to the inserting. The serial bus receptacle may be included in a housing, which includes or is coupled to a clamp, and where the clamp is external to the serial bus receptacle.

In 1004, the clamp may be adjusted via a clamping adjustment mechanism to constrain the one or more internal retention springs. The constraining of the one or more internal retention springs augments the retention force of the one or more internal retention springs and further secures the male serial bus plug in the serial bus receptacle.

In various embodiments, the method may include communicatively coupling any of various serial communication devices to a serial communications bus. For example, the male serial bus plug may be communicatively coupled to a serial communication device, and so inserting the male serial bus plug into the serial bus receptacle (1002) may connect the serial communication device to the serial communication bus. In one embodiment, the serial communication bus may USB, the serial bus receptacle may be a USB receptacle, the male serial bus plug may by a USB plug, and the serial communication device may be a USB device.

In other embodiments, the serial communication device may be communicatively coupled to the serial communication bus via a serial communication cable as illustrated in 9A-9B and described above. For example, the male serial bus plug may be communicatively coupled to a serial communication device, and so inserting the male serial bus plug into the serial bus receptacle (1002) may connect the serial communication device to the serial communication bus via the serial communication cable. In various embodiments, the serial communication bus may be USB, the serial bus receptacle may be a USB receptacle, the male serial bus plug may be a USB plug, and the serial communication device may be a USB device, and the serial communication cable may be a USB cable.

In various other embodiments, the method may include any of the clamping adjustment mechanisms described above and illustrated in FIGS. 3-8.

Although the embodiments above have been described in considerable detail, numerous variations and modifications will become apparent to those skilled in the art once the above disclosure is fully appreciated. It is intended that the following claims be interpreted to embrace all such variations and modifications.

We claim:

1. A system, comprising:

a housing, wherein the housing is configured to couple to a serial communication bus;

a serial bus receptacle comprised in the housing, wherein the serial bus receptacle is configured to communicatively couple to the serial communication bus and comprises one or more internal retention springs situated inside the serial bus receptacle, and configured to grip a male serial bus plug with a retention force when the male serial bus plug is inserted into the serial bus receptacle;

a clamp, comprised in or coupled to the housing, wherein the clamp is external to the serial bus receptacle; and a clamping adjustment mechanism configured to couple to the clamp, wherein the clamping adjustment mechanism comprises:

one or more threaded fasteners; and one or more threaded nuts; and wherein the clamp is configured to close in response to the one or more threaded fasteners being threaded into the one or more threaded nuts;

wherein, when the male serial bus plug is inserted into the serial bus receptacle, the clamp is adjustable via the clamping adjustment mechanism to constrain the one or more internal retention springs, thereby augmenting the retention force of the one or more internal retention springs, and thereby further securing the male serial bus plug in the serial bus receptacle.

2. The system of claim 1, wherein the serial communication receptacle is a Universal Serial Bus (USB) receptacle, the serial bus plug is a USB plug, and the serial communication bus is USB.

3. The system of claim 1, further comprising:

a serial communication cable, wherein the housing is comprised on a first end of the serial communication cable, and wherein the serial bus receptacle is communicatively coupled to the serial communication bus via the serial communication cable.

4. The system of claim 3, wherein the serial communication cable comprises a USB cable, and wherein the serial bus receptacle comprises a USB receptacle.

5. The system of claim 3, further comprising:

another male serial bus plug, comprised on a second end of the serial communication cable.

6. The system of claim 5, wherein the other male serial bus plug comprises a USB plug.

7. The system of claim 3, wherein the housing is a first housing, wherein the serial bus receptacle is a first serial bus receptacle, wherein the clamp is a first clamp, and wherein the clamping adjustment mechanism is a first clamping adjustment mechanism, wherein the system further comprises:

a second housing, comprised on a second end of the serial communication cable;

a second serial bus receptacle comprised in the second housing and communicatively coupled to the serial communication cable, wherein the second serial bus receptacle comprises one or more internal retention springs situated inside the second serial bus receptacle, and configured to grip a second male serial bus plug with a retention force when the second male serial bus plug is inserted into the second serial bus receptacle; and a second clamp, comprised in or coupled to the second housing, wherein the second clamp is external to the second serial bus receptacle;

wherein, when the second male serial bus plug is inserted into the second serial bus receptacle, the second clamp is adjustable to constrain the one or more internal retention springs, thereby augmenting the retention force of the one or more internal retention springs, and thereby further securing the second male serial bus plug in the second serial bus receptacle.

8. The system of claim 7, wherein the serial communication cable comprises a USB cable, and wherein the serial bus receptacles comprise USB receptacles.

9. The system of claim 1, wherein the clamping adjustment mechanism comprises:

one or more threaded fasteners; and a corresponding one or more threaded inserts, comprised in or coupled to the housing; and wherein the clamp is configured to close in response to the one or more threaded fasteners being threaded into the corresponding one or more threaded inserts.

10. The system of claim 1, wherein the clamp has a deploy position in which the clamp is closed, thereby further securing the male serial bus plug in the serial bus receptacle, and a service position in which the clamp is opened, thereby allowing the removal of the male serial bus plug from the serial bus receptacle.

11. The system of claim 1, wherein the housing is comprised in or coupled to a panel;

wherein the serial communication receptacle protrudes through or is accessible from a front side of the panel; and wherein the clamping adjustment mechanism protrudes through or is accessible from the front side of the panel.

12. A method, comprising:

inserting a male serial bus plug into a serial bus receptacle, wherein the serial bus receptacle is communicatively coupled to a serial communication bus;

wherein the serial bus receptacle comprises one or more internal retention springs situated inside the serial bus receptacle, and configured to grip the male serial bus plug with a retention force in response to said inserting, wherein the serial bus receptacle is comprised in a housing, wherein the housing comprises or is coupled to a clamp, wherein the clamp is external to the serial bus receptacle; and adjusting the clamp via a clamping adjustment mechanism to constrain the one or more internal retention springs, thereby augmenting the retention force of the one or more internal retention springs, and thereby further securing the male serial bus plug in the serial bus receptacle, wherein the clamping adjustment mechanism comprises:

one or more threaded fasteners; and a corresponding one or more threaded inserts, comprised in or coupled to the housing;

wherein said adjusting the clamp via the clamping adjustment mechanism comprises threading the one or more threaded fasteners into the corresponding one or more threaded inserts.

13. The method of claim 12, wherein the serial communication receptacle is a Universal Serial Bus (USB) receptacle, the serial bus plug is a USB plug, and the serial communication bus is USB.

14. The method of claim 12, wherein the male serial bus plug is communicatively coupled to a serial communication device, and wherein said inserting the male serial bus plug into the serial bus receptacle connects the serial communication device to the serial communication bus.

15. The method of claim 12, wherein the serial bus receptacle comprises a USB receptacle, wherein the male serial bus plug comprises a USB plug, and wherein the serial communication device is a USB device.

16. The method of claim 12, wherein the housing is coupled to a first end of the serial communication cable;

wherein the serial bus receptacle is communicatively coupled to the serial communication bus via the serial communication cable;

wherein the male serial bus plug is communicatively coupled to a serial communication device; and wherein said inserting the male serial bus plug into the serial bus receptacle connects the serial communication device to the serial communication bus via the serial communication cable.

17. The method claim 16, wherein the serial communication cable comprises a USB cable, wherein the serial bus receptacle comprises a USB receptacle, wherein the other serial communication bus comprises a universal serial bus, wherein the male serial bus plug is a USB plug, and wherein the serial communication device is a USB device.

18. The method of claim 12, wherein the clamping adjustment mechanism comprises:

one or more threaded fasteners; and a corresponding one or more threaded inserts, comprised in or coupled to the housing;

wherein said adjusting the clamping adjustment mechanism comprises threading the one or more threaded fasteners into the corresponding one or more threaded inserts.

19. The method of claim 12, wherein the housing is comprised in or coupled to a panel;

wherein the serial communication receptacle protrudes through or is accessible from a front side of the panel;

wherein the clamping adjustment mechanism protrudes through or is accessible from the front side of the panel; and wherein said adjusting the clamping adjustment mechanism occurs on the front side of the panel.

20. The method of claim 12, wherein the clamp is adjustable to a deploy position in which the clamp is closed, thereby further securing the male serial bus plug in the serial bus receptacle, and wherein the clamp is adjustable to a service position in which the clamp is open, thereby allowing the removal of the male serial bus plug from the serial bus receptacle.

21. A system, comprising:

a first housing, wherein the first housing is configured to couple to a serial communication bus;

a first serial bus receptacle comprised in the first housing, wherein the first serial bus receptacle is configured to communicatively couple to the serial communication bus and comprises one or more internal retention springs situated inside the first serial bus receptacle, and configured to grip a first male serial bus plug with a retention force when the first male serial bus plug is inserted into the first serial bus receptacle;

a serial communication cable, wherein the first housing is comprised on a first end of the serial communication cable, and wherein the first serial bus receptacle is communicatively coupled to the serial communication bus via the serial communication cable;

a first clamp, comprised in or coupled to the first housing, wherein the first clamp is external to the first serial bus receptacle;

a first clamping adjustment mechanism configured to couple to the first clamp;

wherein, when the first male serial bus plug is inserted into the first serial bus receptacle, the first clamp is adjustable via the first clamping adjustment mechanism to constrain the one or more internal retention springs, thereby augmenting the retention force of the one or more internal retention springs, and thereby further securing the first male serial bus plug in the first serial bus receptacle;

a second housing, comprised on a second end of the serial communication cable;

a second serial bus receptacle comprised in the second housing and communicatively coupled to the serial communication cable, wherein the second serial bus receptacle comprises one or more internal retention springs situated inside the second serial bus receptacle, and configured to grip a second male serial bus plug with a retention force when the second male serial bus plug is inserted into the second serial bus receptacle; and a second clamp, comprised in or coupled to the second housing, wherein the second clamp is external to the second serial bus receptacle;

wherein, when the second male serial bus plug is inserted into the second serial bus receptacle, the second clamp is adjustable to constrain the one or more internal retention springs, thereby augmenting the retention force of the one or more internal retention springs, and thereby further securing the second male serial bus plug in the second serial bus receptacle.

22. A method, comprising:

inserting a first male serial bus plug into a first serial bus receptacle, wherein the first serial bus receptacle is communicatively coupled to a serial communication bus;

wherein the first serial bus receptacle comprises one or more internal retention springs situated inside the first serial bus receptacle and configured to grip the first male serial bus plug with a retention force in response to said inserting, wherein the first serial bus receptacle is comprised in a first housing, wherein the first housing comprises or is coupled to a first clamp, wherein the first clamp is external to the first serial bus receptacle, wherein the first housing is comprised on a first end of a serial communication cable, and wherein the first serial bus receptacle is communicatively coupled to the serial communication bus via the serial communication cable;

inserting a second male serial bus plug into a second serial bus receptacle, wherein the second serial bus receptacle is communicatively coupled to the serial communication bus;

wherein the second serial bus receptacle comprises one or more internal retention springs situated inside the second serial bus receptacle and configured to grip the second male serial bus plug with a retention force in response to said inserting, wherein the second serial bus receptacle is comprised in a second housing, wherein the second housing comprises or is coupled to a second clamp, wherein the second clamp is external to the second serial bus receptacle, wherein the second housing is comprised on a second end of a serial communication cable, and wherein the second serial bus receptacle is communicatively coupled to the serial communication bus via the serial communication cable;

adjusting the first clamp via a first clamping adjustment mechanism to constrain the one or more internal retention springs, thereby augmenting the retention force of the one or more internal retention springs, and thereby further securing the first male serial bus plug in the first serial bus receptacle; and adjusting the second clamp via a second clamping adjustment mechanism to constrain the one or more internal retention springs, thereby augmenting the retention force of the one or more internal retention springs, and thereby further securing the second male serial bus plug in the second serial bus receptacle.

* * * * *